United States Patent [19]

Fay et al.

[11] B 3,989,937

[45] Nov. 2, 1976

[54] INTERACTIVE ROLL GAP-REVERSE ROLL SPEED CONTROL OF THE APPLICATOR OF A MATERIAL TREATER

[75] Inventors: Charles Robert Fay; James Douglas Richter, both of Cincinnati, Ohio

[73] Assignee: Formica Corporation, Cincinnati, Ohio

[22] Filed: Nov. 1, 1974

[21] Appl. No.: 520,082

[44] Published under the second Trial Voluntary Protest Program on March 23, 1976 as document No. B 520,082.

[52] U.S. Cl. ..... 235/151.1; 235/151.3; 118/8; 118/9

[51] Int. Cl.[2] ..... G06G 7/58

[58] Field of Search ..... 235/151.13, 151.12, 235/151.1, 151.11, 151.3, 151.33, 151.35; 73/23, 150; 118/8, 9; 117/66

[56] References Cited

UNITED STATES PATENTS

| | | | |
|---|---|---|---|
| 3,073,153 | 1/1963 | Petitjean | 73/73 |
| 3,260,642 | 7/1966 | Canter, Jr. | 162/252 |
| 3,378,676 | 4/1968 | Clement | 235/151.3 |
| 3,596,071 | 7/1971 | Doering | 235/151.35 X |

*Primary Examiner*—Edward J. Wise
*Attorney, Agent, or Firm*—Frank M. Van Riet

[57] ABSTRACT

An improved process and apparatus are disclosed wherein the resin solution treatment of a web on a material treater is conducted by interactively adjusting the roll gaps of a reverse roll applicator in conjunction with applicator roll speed changes.

10 Claims, 9 Drawing Figures

260, FIG'S. 3, 4 & 5
TO 170
PAPER SOLIDS
TOTAL SOLIDS
% $V_A$ SPEC WITH $h_A$, FIG. 5 OR % $V_A$ ACTUAL WITH $h_i$, FIG. 4
θ = TIME (SEC.)
TO 290, FIG. 4
TO 630, FIG. 5
1 SEC.
FROM 1105
FROM 108
FROM 170
FROM 280 OR FROM 350, FIG. 4
FROM 15A
FROM 47
FROM 48
FROM 160
FROM 250 FIG. 3
$W_T$ INITIAL
$T_W = 80°F$
$T_{W_0}$
$P_1 = 211°F$
$P_2 = 0$
$P_1 = W_{S_1F}$
$P_1 = W_{S_2F}$
$P_1 = W_{S_3F}$
$P_1 = W_{S_4F}$
$W_{S_1} = 0$
$W_{S_2} = 0$
$W_{S_3} = 0$
$W_{S_4} = 0$
$\theta_0 = 0$

INTERACTIVE ROLL GAP-REVERSE ROLL SPEED CONTROL OF THE APPLICATOR OF A MATERIAL TREATER

BACKGROUND OF THE INVENTION

The use of control apparatus in processes for the production of treated materials has become more and more widespread in recent years. High costs of labor, increased incidences of decreased quality and the need for more uniformity in products have been the prime motivating forces behind the switch over.

In the treating of materials, e.g. the coating, impregnation etc. and drying of materials such as paper, cloth etc. it has especially become increasingly desirable to utilize a fully automatic process and U.S. Pat. No. 3,596,071 is directed to a system which approaches such a realization. This patent discloses and claims a method and apparatus for the control of a coater and dryer wherein variables such as moisture content, resins solids concentration, percent resin and percent volatiles are measured and/or computed according to various mathematical formulae. The computed values are then used to control the rate of resins application and the drying rate of the treated material. The controls effected by the patentee are of the conventional feedback type. Analog computers and controllers are utilized to adjust the applicator roll speed, based on the percent resins solids calculation deviation from set point.

The patentee, however, does not provide means for automatically adjusting the roll gaps of the reverse roll applicator in conjunction with applicator roll speed changes and therefore resin consumption remains relatively high and/or filler and laminate quality is substantially lower than would be preferred.

SUMMARY

We have now discovered a new and novel improvement which overcomes many of the difficulties exhibited by prior art control procedures and apparatus in the treatment of material webs. Our invention utilizes a unique interaction of roll gap control in conjunction with roll speed changes.

Roll gap adjustment is necessary for the control of a reverse roll applicator in order to differentiate between resin systems which generally vary considerably one from another in percent solids, viscosities, and other resin parameters important to the application operation. Typically, as the resin solids decrease, and/or as the resin viscosity decreases, a faster reverse roll speed or a larger roll gap is needed in order to deposit the required amount of resin solids onto the web material as specified by, for example, percent Ra, see above patent, or other resin calculation. As the resin viscosity decreases, a larger gap is required since roll speeds which are too high with low viscosity resins results in "slinging" of the resin solution due to a lowered adhesive strength between the roll and the resin. The converse of the above is also true. If a high solids resin solution is used, the roll gaps need to be decreased since if only the applicator roll speed is varied, the resultant speed can be below the line speed of the material going through the treater. It is generally well recognized that applicator roll speeds which are less than line speeds result in a phenomenon called "skip coating," or a loss of uniform deposition weight. Any discontinuities in deposition weight on a material results in finished products which must be rejected.

Our invention overcomes the deficiencies of the above U.S. patent by utilizing an interactive control scheme with the applicator roll gap settings being automatically controlled in conjunction with changes in applicator roll speed. Since it is desirable to maintain the ratio of applicator roll speed to material line speed above about 1:1 and below some high ratio (dependent upon the resin system), where adhesion between the resin and the applicator roll or other rolls is lowered to the point where resin is thrown therefrom, our invention maintains this ratio within predetermined high and low limits. This control of the applicator system results in the saving of large quantities of resin and a more uniform product.

BRIEF DESCRIPTION OF THE DRAWINGS

FIGS. 3–5 represent a diagram showing the calculations involved in determining the inputs to the Model Analog Diagram of FIG. 6A and 6B.

DESCRIPTION OF THE INVENTION INCLUDING PREFERRED EMBODIMENTS

As mentioned briefly above, our invention comprises a method and apparatus for the interactive roll gap-applicator roll speed control of the treating operation of a material treater. Our invention permits the automatic operation of a reverse roll applicator at optimum operating conditions assuring a uniform application at the precise deposition weight required for the optimum properties of any given web treated material. The apparatus of our invention simultaneously calculates and controls the roll gap set point and the applicator roll speed set point through a combination of ratio and feed forward control.

In a preferred embodiment, the ratio of applicator roll speed to material treater line speed is maintained within a given range, preferably from about 1:1 to about 2:1 utilizing an applicator model to calculate the required applicator roll speed set point needed to maintain a given percent Ra or other measure of resin pick-up by the web. The ratio is then calculated from this required applicator roll speed set point and from the required line speed set point which is determined from a dryer model. This ratio is compared to predetermined desired ratio high and low limits. A new applicator roll speed set point, along with new roll gap set points, are calculated in order to maintain the ratio within the desired limits and to maintain the desired resin pick-up by the web.

Figure 1:
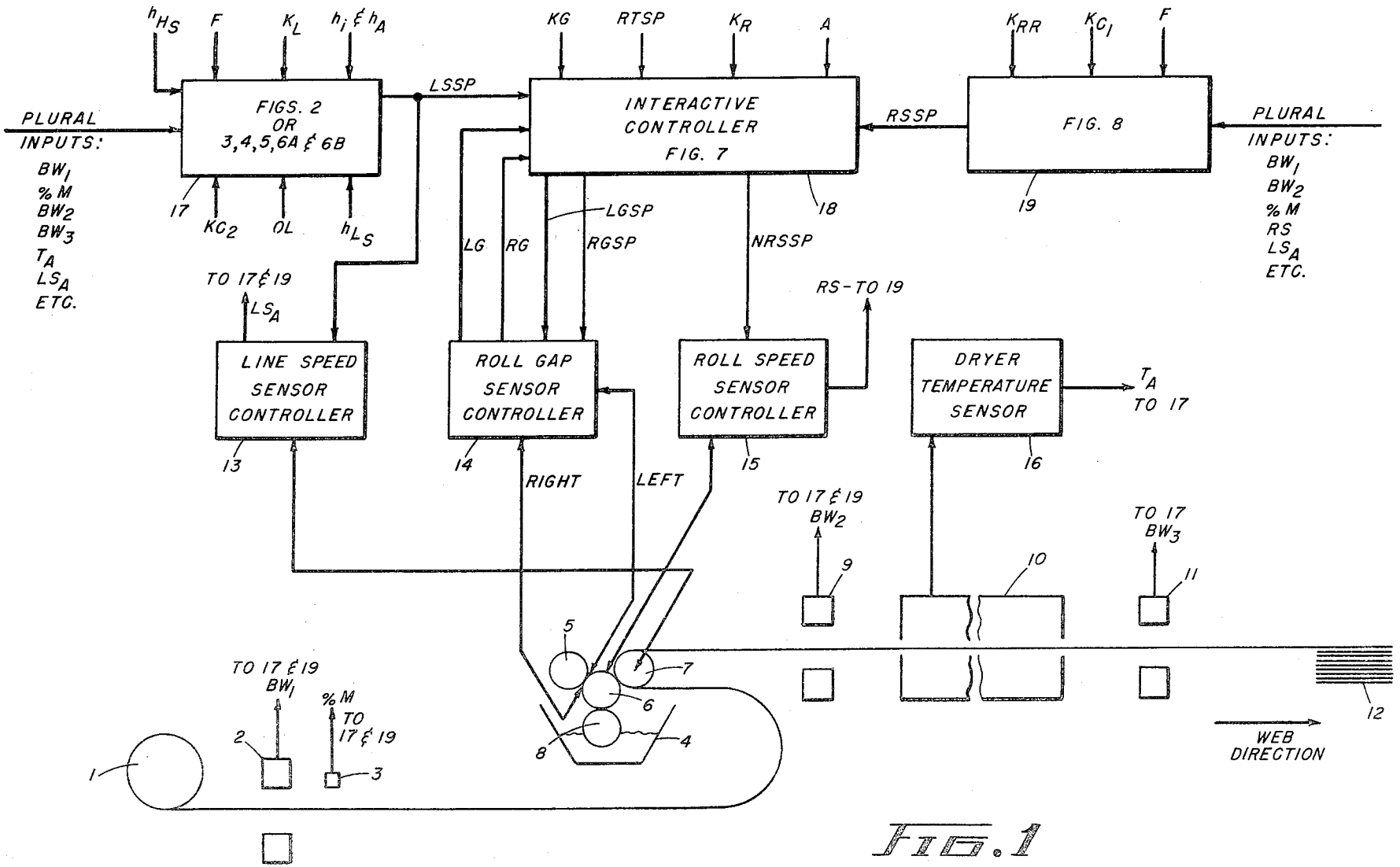
FIG. 1 is a diagrammatic view of an applicator and drying process for a material treater, showing a series of gauges, reverse roll applicator (e.g. a coater), dryer and stacking equipment and the control system configuration required to conduct the process including means for calculating and controlling the roll gaps, roll speed and line speed of the system.

To better understand our invention, reference is hereby made to FIG. 1 of the attached drawings. The raw web unwinds from roll 1, passes through beta gauge 2 and a signal representative of the raw paper basis weight, $BW_1$, thereof, emits therefrom. Since gauge 2 is usually of the scanning variety, a series of readings can be made from this gauge and the readings, from one section of the web or a plurality of sections thereof, can be averaged to determine an average $BW_1$. From 2, the web passes through moisture gauge 3 which provides a measurement of the percent moisture in the web before treatment. The web then passes into a reverse roll applicator 4 where the correct amount of a given resin solution is deposited thereon. The resultant wet, resin treated web continues through beta gauge 9, wherein the wet product basis weight, $BW_2$, is measured, and is dried in dryer 10. The final product weight, $BW_3$, is subseqeuntly measured by beta gauge 11 and the treated, dried web is finally processed such as by cutting and stacking at 12 or in any other desired manner.

Gauges 9 and 11 are not essential and can be removed from the system if desired. If they are removed, weights $BW_2$ and $BW_3$ can be calculated utilizing predetermined constants etc. determined in relation to $BW_1$ and the resultant calculated $BW_2$ and $BW_3$ may be used in the model diagrams discussed hereinbelow whenever desired.

Applicator 4 is a four roll reverse roll applicator commercially available from many sources. The operation of the applicator is generally standard and proceeds as follows. Roll 8 is called the pick-up roll and an excess of resin solution is deposited thereon as it turns in the resin pan. The resin is transferred from roll 8 to roll 6 which is the applicator roll, a variable speed roll, and the excess resin solution is removed at the gap between roll 6 and roll 5. Roll 6 transfers the resin solution to the web at the contact point between roll 6 and pressure roll 7.

The normal control of a four roll, reverse roll applicator involves setting the speed of roll 8 and the gap between rolls 8 and 6 to allow an excess of resin to be brought up to the gap between rolls 5 and 6. Generally, the speed of roll 5 is about 10 percent of the speed of roll 7, roll 7 being at the line speed of the material. The gap between rolls 5 and 6 is called the metering gap and is the gap controlled according to our invention. The speed of roll 6 is normally between a 1:1 and 2:1 ratio with the material line speed. Our invention maintains the desired ratio range and controls the gap between rolls 5 and 6 to maintain this ratio.

Figure 2:
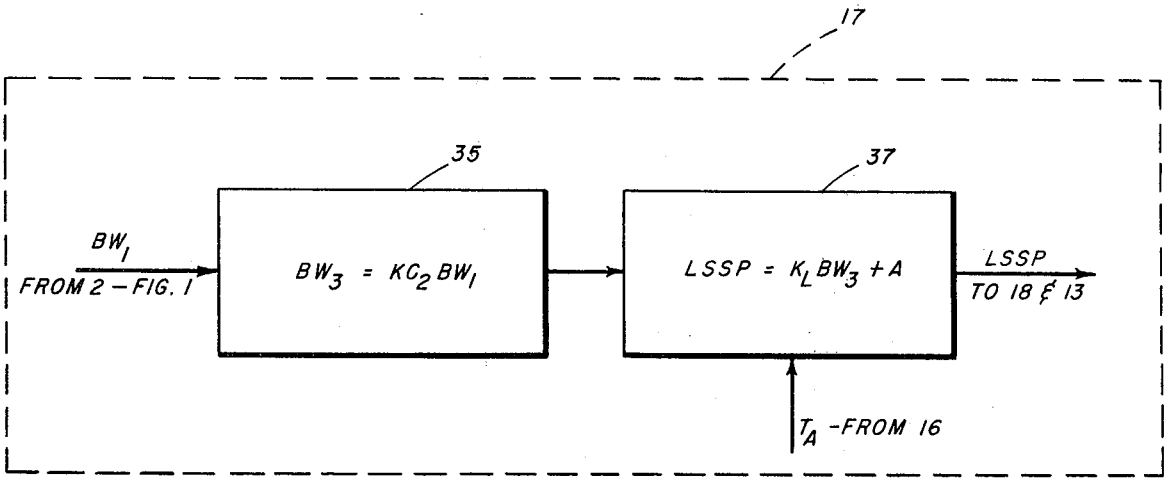
FIG. 2 is a Model Diagram sample which may be used in determining the required line speed set point as shown in block 17 of FIG. 1.

The line speed sensor-controller 13 senses the actual material line speed. This actual line speed, $LS_A$, along with $BW_1$, from 2, $BW_2$ from 9, $BW_3$ from 11, percent M from 3, $T_A$ from dryer temperature sensor 16, the resin solids fraction F and $h_i$ and $h_A$, film coefficients of the treated material, are inputs to block 17 where the calculations of FIGS. 3–5 and the model of FIGS. 6A and 6B are employed to determine the required line speed set point, LSSP. The model of FIGS. 6A and 6B is just an example and can be any type of model relating any equation for dryer control, such as percent Va, to actual material line speed, $LS_A$. Another typical and useful model is shown in FIG. 2. In this figure, $BW_1$ is transmitted from beta gauge 2, as mentioned above, and the desired final weight, $BW_3$, is calculated in block 35, rather than being sent from gauge 11, which would be omitted as previously set forth, using constant $KC_2$ which is determined arithmetically from the equation $$\%Va = 100 + \frac{BW_3 - \left[(BW_2 - BW_1)F + BW_1\left(1 - \frac{\%M}{100}\right)\right]}{BW_1\left(1 - \frac{\%M}{100}\right)}$$

where percent Va and F, the resin solids fraction, are predetermined values and $BW_1$, $BW_2$, and percent M are measured at 2, 9 and 3, respectively. The lines speed set point is then calculated in block 37 and is outputted to interactive controller 18 and controller 13. $T_A$ is the oven temperature from 16 while tuning constants $K_L$ and A are determined experimentally to give good control and are periodically revised and corrected using standard on-line adaptive control techniques. The oven temperature, $T_A$, is an input to box 37, since the tuning parameters $K_L$ and/or A are generally temperature dependent. For example, an array could be stored in the computer so that for $T_A$ , $A_1$ would be used in the control equation of box 37 to determine LSSP, the line speed set point.

Figure 4:
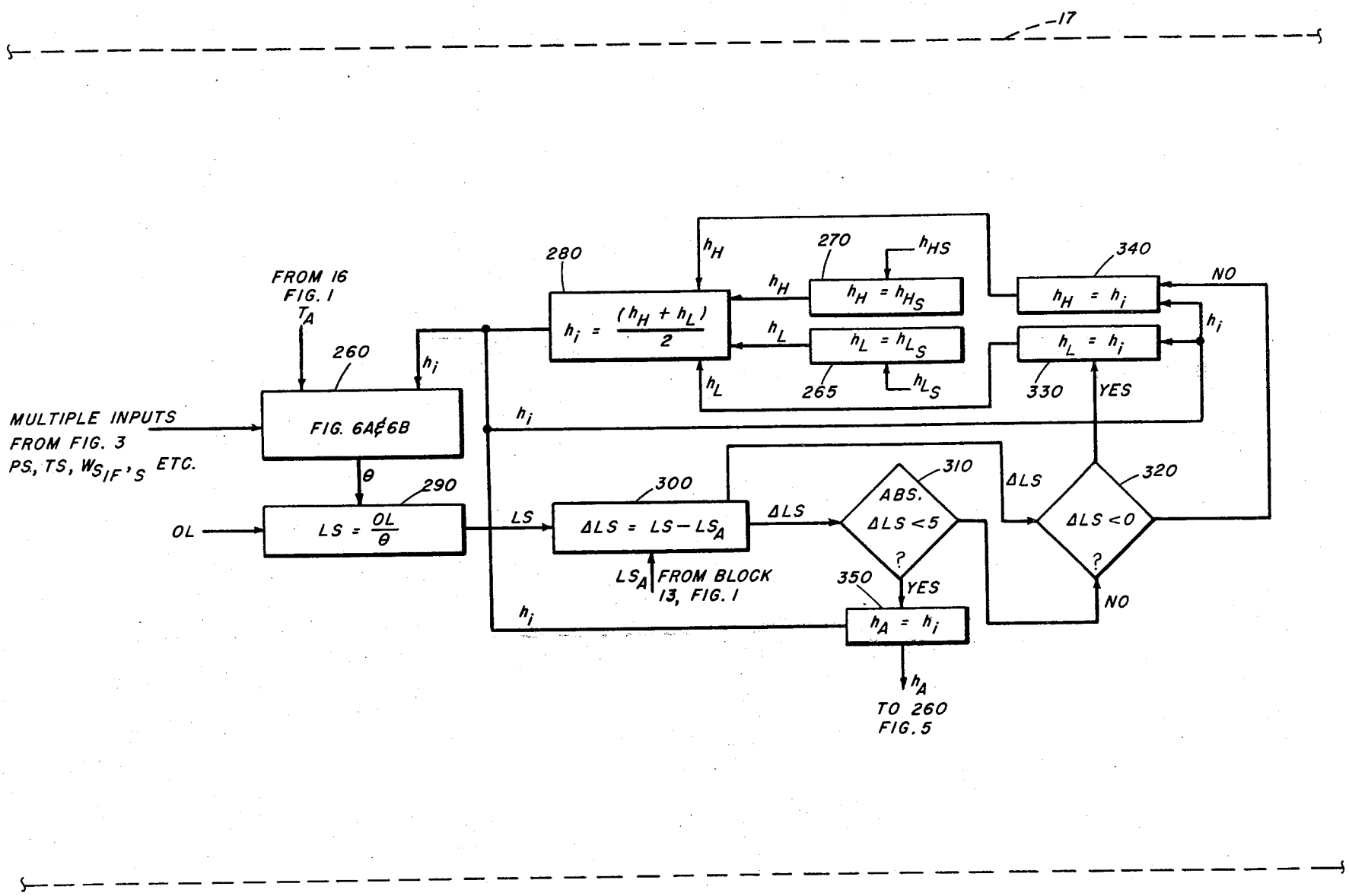
Figure 5:
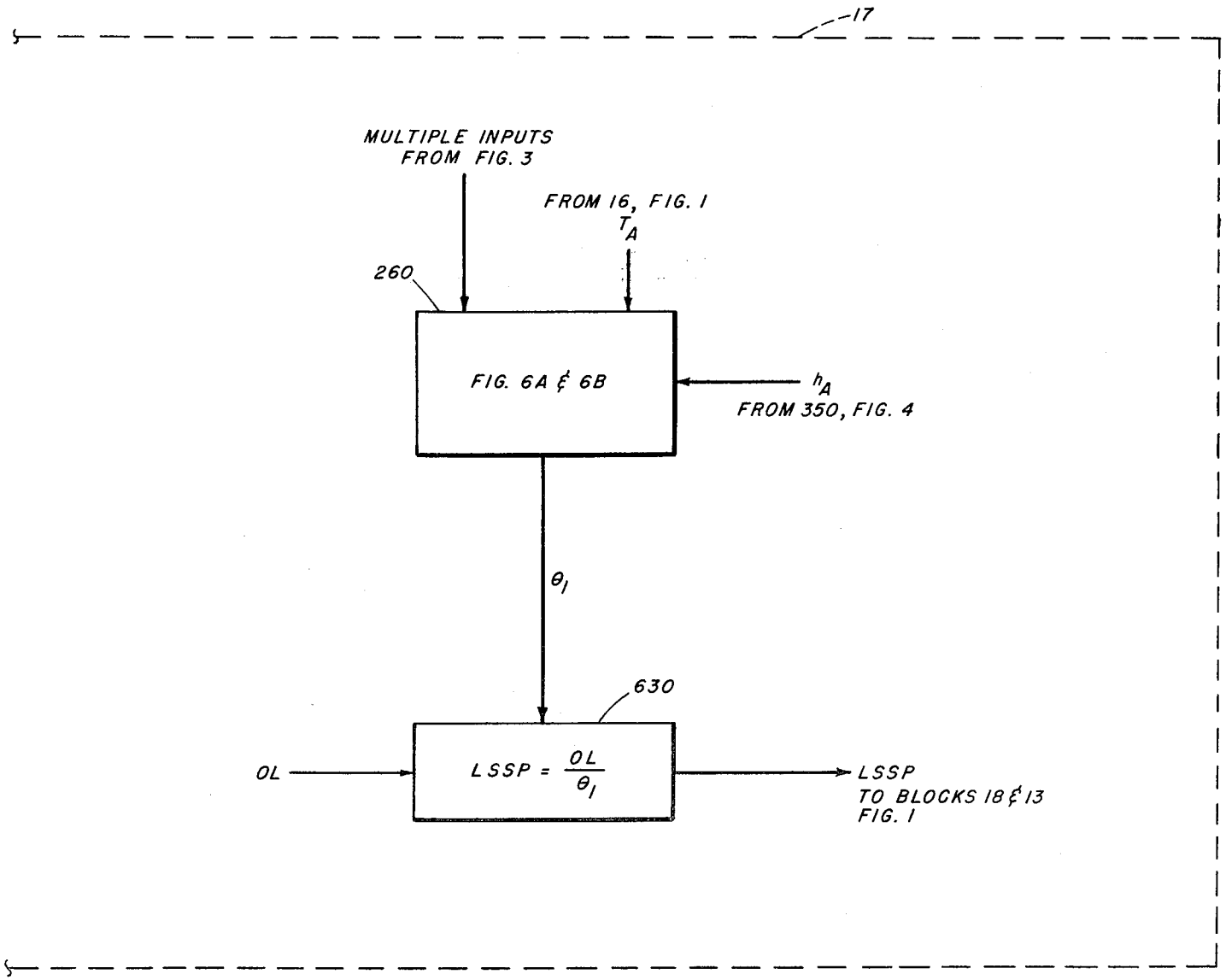
Figure 6A:
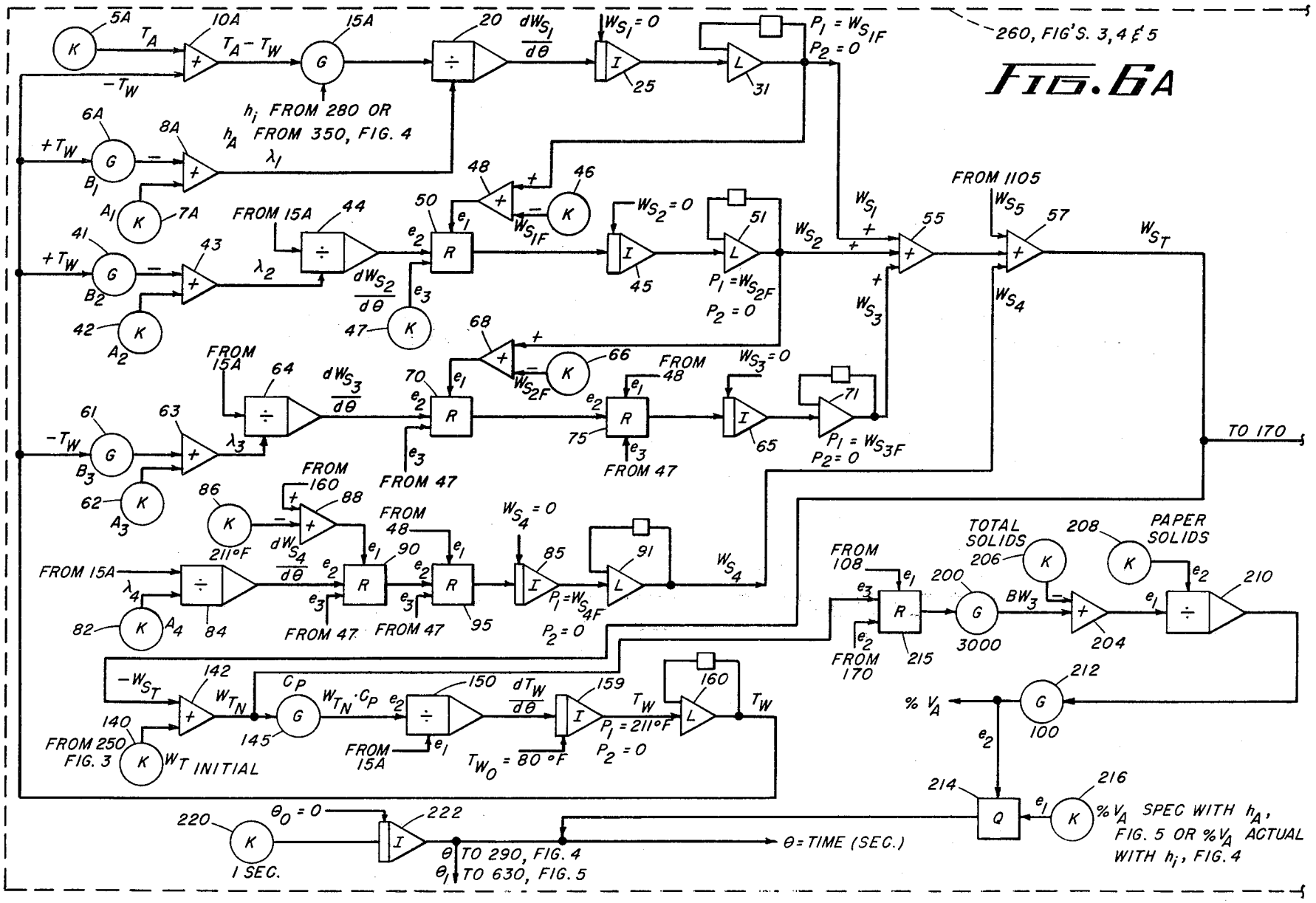
FIG. 6A and 6B is a second Model Diagram which may be used in the instant invention to determine the required line speed set point as shown in block 17 of FIG. 1.
Figure 6B:
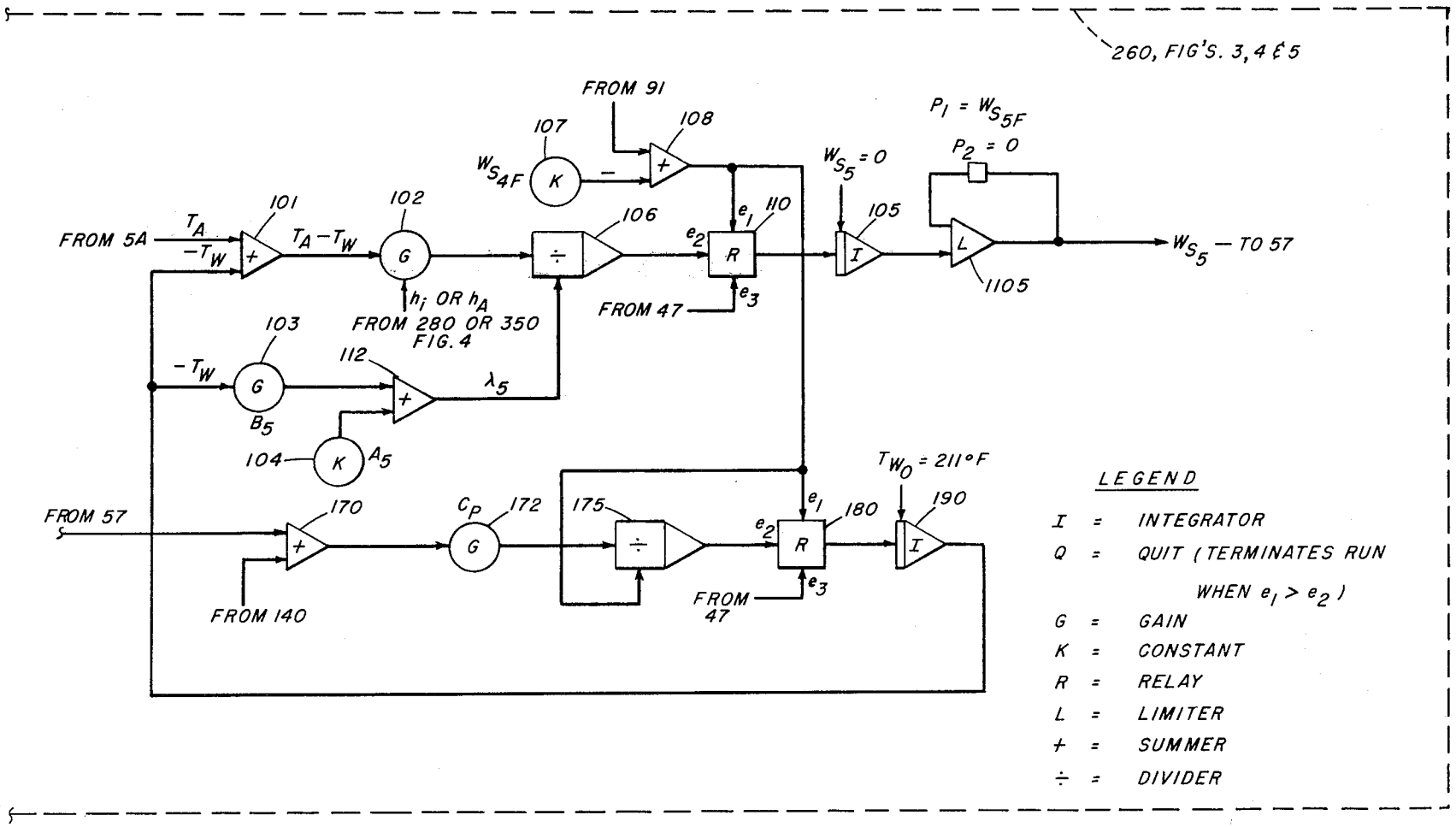
Figure 7:
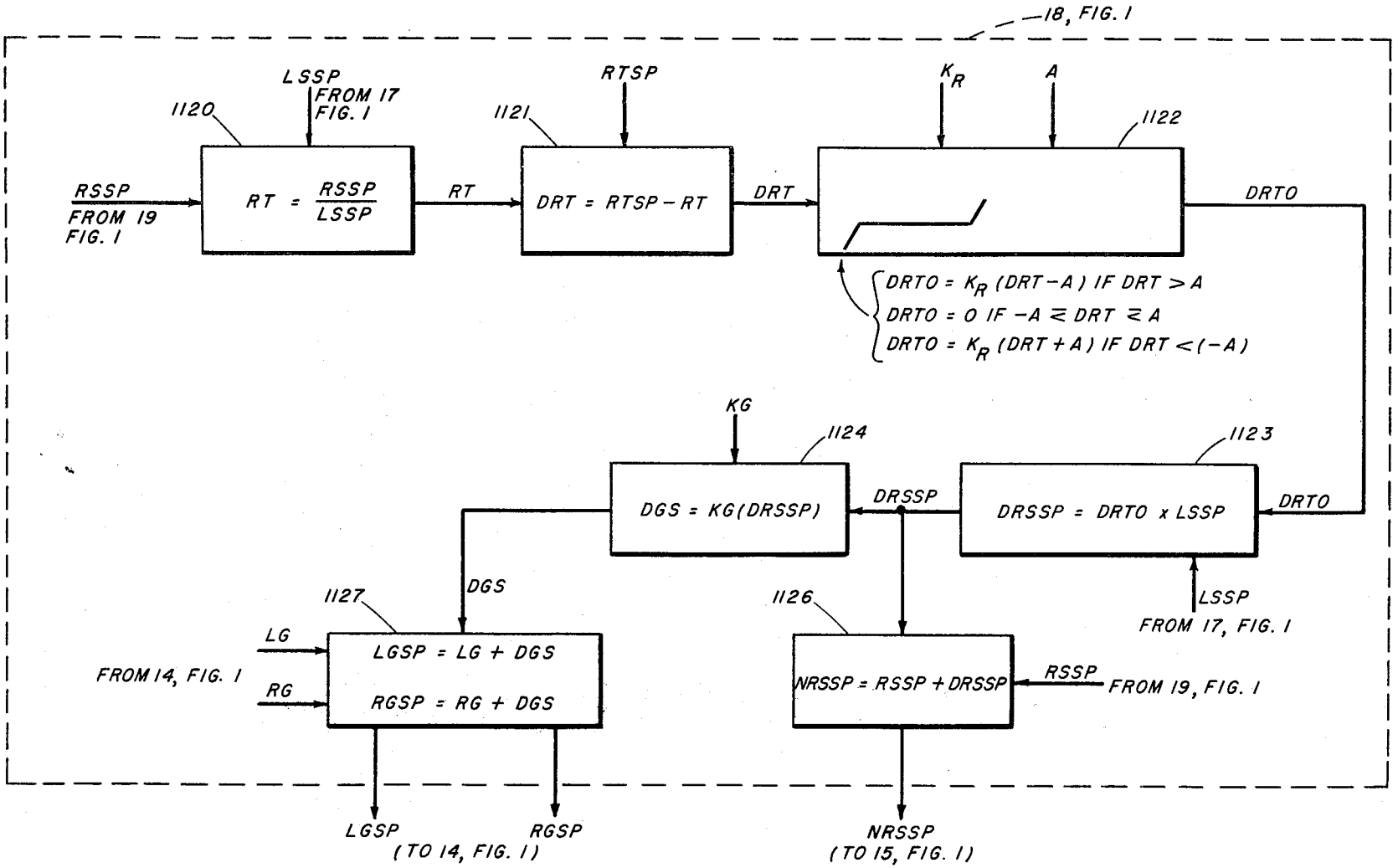

When the model shown by FIGS. 6A and 6B is used in conjunction with the calculations shown in FIGS. 3–5, the following technique is followed. This model utilizes the film coefficients, $h_i$ and $h_A$, calculated as set forth in copending application, Ser. No. 520,063 filed concurrently herewith by C. R. Fay and hereby expressly incorporated herein by reference, to calculate the line speed set point, LSSP, which is used in interactive controller 18 to control the roll gap and roll speed of applicator 4.

The $h_i$ and $h_A$ values are the only tuning factors involved in this model. The values are self-adaptive since they are calculated continually. Referring again to FIG. 1, the beta gauge system utilized in providing inputs to this model is detailed in U.S. Pat. No. 3,596,071. The percent Ra resin and %Va voltatiles, as described above, in this instance, can be, but are not restricted to the same calculations, e.g. that above and $$\%\text{Resin} = \%Ra = \frac{\text{Resin Solids}}{\text{Paper Fiber}} = \frac{(BW_2 - BW_1)F}{BW_1\left(1 - \frac{\%M}{100}\right)} \times 100$$

wherein $BW_2$, $BW_1$, F and %M are as previously set forth.

To calculate the film coefficients, $h_i$ and $h_A$, it is necessary to relate the values to the drying of a given resin-web system. FIGS. 3 and 6A and 6B are examples of a means that can be used to relate these values to the drying of a resin-web system through a treater model, a mathematical model of the drying operation of a material treater.

FIG. 3 is a block diagram showing the calculations of the inputs to the model, FIG. 6A and 6B, shown as block 260. Referring to FIG. 3, block 235 provides the Vapor Phase Chromotograph (VPC) analysis of the resin which is applied to the given web. The device can be replaced by any off-line analysis or any on-line continuous measuring device which could be used to determine the percentage composition of the solvents in the resin system. For the example under study, five solvent components are involved and are analyzed, with resulting percents by weight given as percent $W_{S_1}$, percent $W_{S_2}$, percent $W_{S_3}$, percent $W_{S_4}$, and percent $W_{S_5}$. Block 230 calculates $W_S$, the total weight of wet resin (resin solvents plus solids) per square foot, from $BW_1$ (2, FIG. 1) and $BW_2$ (9, FIG. 1) basis weight readings, in lbs. per 3,000 sq. ft. $W_S$ and percent $W_{S_1}$ are the inputs to block 240, which calculates $W_{S_{1F}}$ (the final weight of the first solvent component in lbs. per sq. ft.), inputs to blocks 31 and 46, respectively, of FIG. 6A. In the same manner, $W_{S_{2F}}$ is calculated in block 241 and is used as inputs to blocks 51 and 66, respectively, of FIG. 6A, $W_{S_{3F}}$ is calculated in block 242, and is used as an input to block 71 of FIG. 6A, $W_{S_{4F}}$ is calculated in block 243 and is used as inputs to blocks 91 and 107, respectively, of FIGS. 6A and 6B, and $W_{S_{5F}}$ is calculated in block 244 and is used as an input to block 1105 of FIG. 6B. The initial web wet weight (weight of web after coating, $BW_2$ by 3,000) $W_T$ initial, in lbs. per sq. ft. is calculated in block 250, and is the input to block 140, FIG. 6A. Block 255 calculates paper solids (PS) (web solids), from inputs to block 255 of $BW_1$ (from 2, FIG. 1) and percent M, moisture from 3, FIG. 1, or a constant manual entry, with PS being an input to block 208, FIG. 6A, and also to block 259. This moisture input is not a necessary portion of the model but is presented here only as a preferred embodiment. Note that if the percent M were a constant manual entry of zero, the method would be identical to no input of moisture. Hence, the previous equations for percent Ra and percent Va would be modified accordingly by replacing all $BW_1$ $$1-\left(\frac{\%M}{100}\right)$$

with $BW_1$. Block 257 calculates the Resin Solids (RS) from $W_S$, from block 230, and F, as defined hereinabove, said F being determined by the ASTM solids test or by instrumentation, a manual or continuously measured or data base entry. The RS value should be multiplied by 3000 in order to equate the bases of the inputs RS and PS for the TS calculation. Block 259 calculates Total Solids (TS) from Resin Solids (RS), block 257, and Paper Solids (PS), block 255, and TS is the input to block 206, FIG. 6A.

FIG. 6A and 6B is a Treater Model Analog Diagram, that is solved either on an analog computer, or by using a digital computer to solve an equivalent digital program.

The following assumptions were made in developing the treater model, the distributed parameter mathematical model of the dryer (modelling the drying of 1 sq. ft. of web as it passes through the dryer):

1. Specific heat of the wet web ($C_p$) can be considered a constant.
2. The changes in humidity of the air in the dryer can be neglected due to the large air volumes.
3. The heat is transferred to the treated web entirely by convection from the heated air.
4. The constant rate of drying equation well represents the total drying in the oven of the treater.
5. The solvents are removed in the order of increasing boiling points and increasing vapor pressures, with the exceptions of phenol and water.
6. Phenol and water are removed as an azeotrope at 211°F., the composition of the azeotrope being 90.8 percent by weight water, 9.2 percent by weight phenol.
7. Additional phenol, due to its high boiling point and low vapor pressures at lower temperatures, and due to the presence of the azeotrope with water at 211°F., will not be removed by itself until after the water present has been used up by the azeotrope.
8. No chemical reaction occurs during the treating operation.

Considering the constant rate of drying, at steady state the heat that flows into the web must be equal to that removed by the evaporated solvents. When air is the only heat source (convective heat transfer only), the balances are as follows:

$$\frac{dQ}{d\theta} = hA\,(T_A - T_w) \tag{1}$$

$$\frac{dW_{si}}{d\theta} = \frac{dQ}{d\theta}/\lambda i \tag{2}$$

thus:

$$\frac{dW_{si}}{d\theta} = \frac{hA\,(T_A - T_w)}{\lambda i} \tag{3}$$

for the heating of any material:

$$\frac{dQ}{d\theta} = W_{T_n}\,Cp\,\frac{dT_w}{d\theta} \tag{4}$$

thus:

$$\frac{dT_w}{d\theta} = \frac{hA}{W_{T_n}\,Cp}\,(T_A - T_w) \tag{5}$$

where:

$dQ/d\theta$ = rate of heat absorption, Btu/sec.

$h$ = film coefficient or convective heat transfer coefficient, $$\frac{\text{Btu}}{\text{sec. ft.}^2\ {}^\circ\text{F.}}$$

A = area of heat transfer surface, sq. ft.; = 1 sq. ft. (basis of calculations)

$T_A$ = air temperature, °F.

$T_w$ = web temperature, °F.

$dW_{si}/d\theta$ = rate of removal of solvent i, lbs./sec.

$C_p$ = heat capacity, Btu/lb.

$W_T$ = weight of 1 sq. ft. of web in dryer, at time $\theta$, pounds $\lambda i$ = latent heat of vaporization of component i, Btu/lb.

Equation 3 is used to solve for $W_{si}$ and equation 5 is used to solve for $T_w$. These two differential equations are solved simultaneously using an analog computer programmed as shown in FIG. 6A and 6B. Referring to FIG. 6A and 6B, the treater model diagram will be described as it relates to phenolic treated paper. Starting at pot 5A, $T_A$, the actual average air temperature of the ovens from 16, FIG. 1, and $-T_W$, the web temperature are summed by amplifier 10A. The resultant $T_A$-$T_W$ signal is passed through a potentiometer 15A with $h_i$ from 280, FIG. 4, to give a gain, to obtain $h_i$.($-T_A$-$T_W$). The $h_i$ is used with percent Va actual in block 216. Correspondingly, the $h_i$ can be replaced with $h_A$ here and in all subsequent equations of the model when used with percent Va spec. for FIG. 5. The latent heat of vaporization for component 1 (methanol in this case) is calculated for the web temperature, $T_W$, by pots 6A and 7A ($B_1$ and $A_1$ are constants) being summed by amplifier 8A. The division circuit 20 then calculates $$\frac{dW_{s1}}{d\theta} = \frac{h_i (T_A - T_W)}{\lambda 1}$$

($A$=1 sq. ft.), equation 3.

Integrator 25 solves $\frac{dW_{s1}}{d\theta}$ for $W_{s1}$ · Limiter 31 limits the integrator 25 output to the total weight ($W_S$ ) of methanol present in the resin used for impregnating the raw paper web. In the same manner, the other alcohols, ethanol 51 and isopropanol 71, are removed during the drying operation. The water:-phenol azeotrope 91 is removed at the azeotrope temperature of 211°F., by holding the web temperature during azeotrope removal at 211°F.

Once the water:phenol azeotrope is removed, the web temperature again increases as phenol, block 1105, is removed, until the final actual percent Va or percent Va spec. is obtained. The actual percent Va is continuously calculated, as described below.

Amplifiers 55 and 57 are used to sum the weight of the components removed by drying at a given time. The total weight removed $W_{ST}$ from Amplifier 57 is inputted to Amplifier 142, along with $W_T$ initial, pot 140, the initial weight of the raw paper and wet resin, ($BW_2$/3,000) in lbs./sq. ft., from block 250, FIG. 3. The resultant $W_T$ , the weight remaining after drying, is then multiplied by Cp (145) to form $W_T$ .Cp. Divide circuit 150 gives (see equation 5)

$$\frac{dT_W}{d\theta} = \frac{h_i (T_A - T_W)}{W_{T_n} \cdot Cp}$$

(since A=1 sq. ft.) and integrator 159 solves for $T_W$ as a function of time. Limiter 160 limits the output of integrator 159° to 211°F., the water:-phenol azeotrope temperature. Once the azeotrope is removed, the analog circuit of Amplifier 101 through Integrator 190 calculates the weight 105 of phenol removed and the web temperature during the phenol removal 190. Relay 215 selects the desired $W_T$ which is multiplied by 3,000 (200) to obtain $BW_3$, in lbs./3,000 sq. ft. percent Va is then calculated by Amplifier 204, pots 206, 212 and divide circuit 210.

The percent Va actual (the desired model output) is the input to block 216. Block 214 compares $e_2$ (percent Va calc.) to $e_1$ (percent Va actual). If $e_1$ is greater than $e_2$, the computer run is terminated. Block 220 inputs a time base (for example, 1 second) to block 222, which is an integrator with an initial value of 0. The output from integrator block 222 is the time ($\theta$) in seconds required for the model to obtain the percent Va calc.=percent Va actual i.e., the drying time. This output corresponds to the model output of block 260, FIG. 4, using $h_i$. Correspondingly, $\theta_1$ is the output from the model of block 260 in FIG. 5, using $h_A$. It should be noted that $e_1$ is the first input to a given block, $e_2$ the second and $e_3$ the third, in all instances.

FIG. 4 is a block diagram showing an example of the determination and calculation of $h_A$, the tuning factor input to block 260, FIG. 5. An "interval halving" convergence method, a well known convergence calculation method, is used to calculate $h_A$; the film coefficient. Any similar convergence method or iterative technique (e.g. Newton-Raphson, Wegstein, secant, etc.) familiar to those skilled in the art can be used in FIG. 4 in place of blocks 265 through 350, inclusive, excluding block 290. Starting at blocks 265 and 270, the initial value of the high $h$, $h_H$, is set equal to an initial estimate high value of $h$, $h_{Hs}$, in block 270, and in the same manner the low value of $h$, $h_L$, is set equal to $h_{Ls}$ in block 265. Block 280 calculates $h_i$ from $h_H$ and $h_L$ with $h_i$ as input to the model, block 260. The other inputs to block 260 are $T_A$ from 16, FIG. 1, and the TS, PS, $WS_F$'s and other inputs as detailed on FIG. 3. The model, block 260, calculates the drying time $\theta$ seconds, as detailed in FIG. 6. Block 290 calculates the treater line speed, LS, from the dryer oven length, OL, and $\theta$. Block 300 calculates ΔLS from LS and $LS_A$, the actual line speed from 13, FIG. 1. Block 310 determines if the absolute value (ABS) of ΔLS is less than the desired line speed error, e.g. 5. If ABS(ΔLS) is less than 5, (or any other value desired), the desired convergence has been achieved, and $h_A$ is set equal to $h_i$ in block 350.

If, however, from block 310 the answer is no, with ABS (ΔLS) > 5, block 320 determines if ΔLS is less than zero. If the answer is yes, then the $h_i$ value used in the previous calculation of the model block 260 is used to improve upon the lower estimate, $h_L$, in block 330, and this $h_L$ is used, along with the same $h_H$ value used previously to calculate a new $h_i$ value. This new $h_i$ value from block 280 is used by block 260 to calculate a new $\theta$ value and hence repeat all calculations as previously described, until the desired convergence is achieved in block 310 and $h_A$ is determined. In the same manner, if the answer from block 320 is no, $h_H$ is set equal to $h_i$ in block 340, and this new $h_H$ is used with the previous value of $h_L$ to calculate a new $h_i$ value in block 280 and the calculations proceed as previously described.

The calculations of FIG. 5 are then performed. The inputs to block 260, the treater model of FIGS. 6A and 6B are the same as previously discussed above. By measuring the inputting $T_A$ to the treater model, block 260, the output (in seconds of drying time) can be used in block 630 to calculate the line speed set point, LSSP, from the oven length, and $\theta_1$, which is used to control the line speed of the material treater via line speed sensor controller 13, at the percent Va spec.

As discussed at length above, the model in block 17 calculates the line speed set point, LSSP, which controls the line speed of the material via sensor-controller 13. The applicator roll speed is read by the roll speed sensor controller 15. The roll speed, RS, is an output to block 19 which is also a model. This model can comprise any model relating the roll speed RS to percent Ra or any other resin control calculation. An example of such a model is the following:

$$\Delta RS = KS.\Delta Ra$$

where:

ΔRS = the change in applicator roll speed, (fpm)

KS = an arbitrary gain constant

ΔRa = deviation of %Ra from the desired set point.

Knowing the previous value of RS, it is possible to calculate the desired applicator roll speed set point, RSSP, from the following:

$$RSSP = RS + \Delta RS$$

The inputs to block 19 for the above exemplary model are $BW_1$ from 2, $BW_2$ from 9, percent M from 3, the resin solids fraction F and RS from 15. The output of block 19 is the roll speed set point, RSSP, which is also an input to interactive controller 18.

Figure 8:
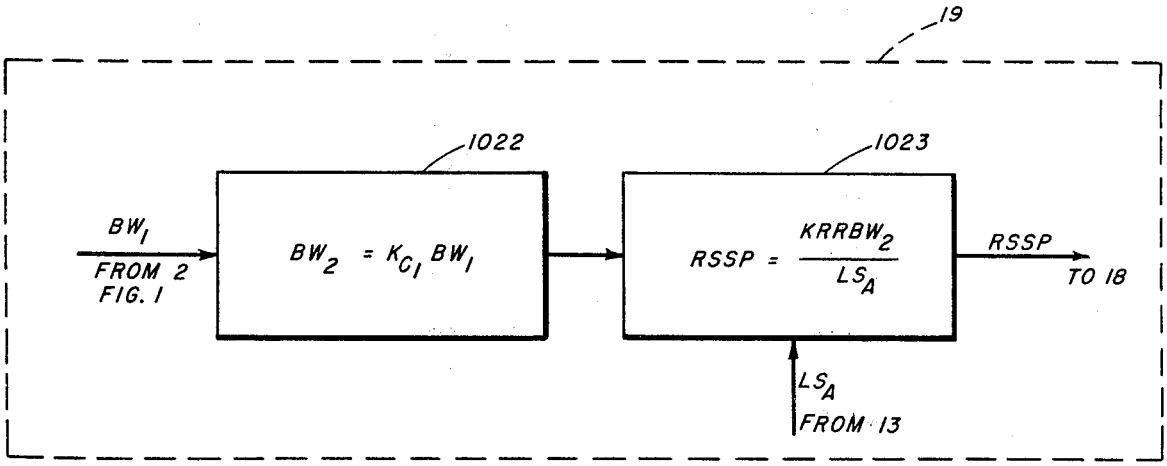
FIG. 8 is a Model Diagram sample which may be used in determining the required roll speed set point as shown in block 19 of FIG. 1.
Figure 7:
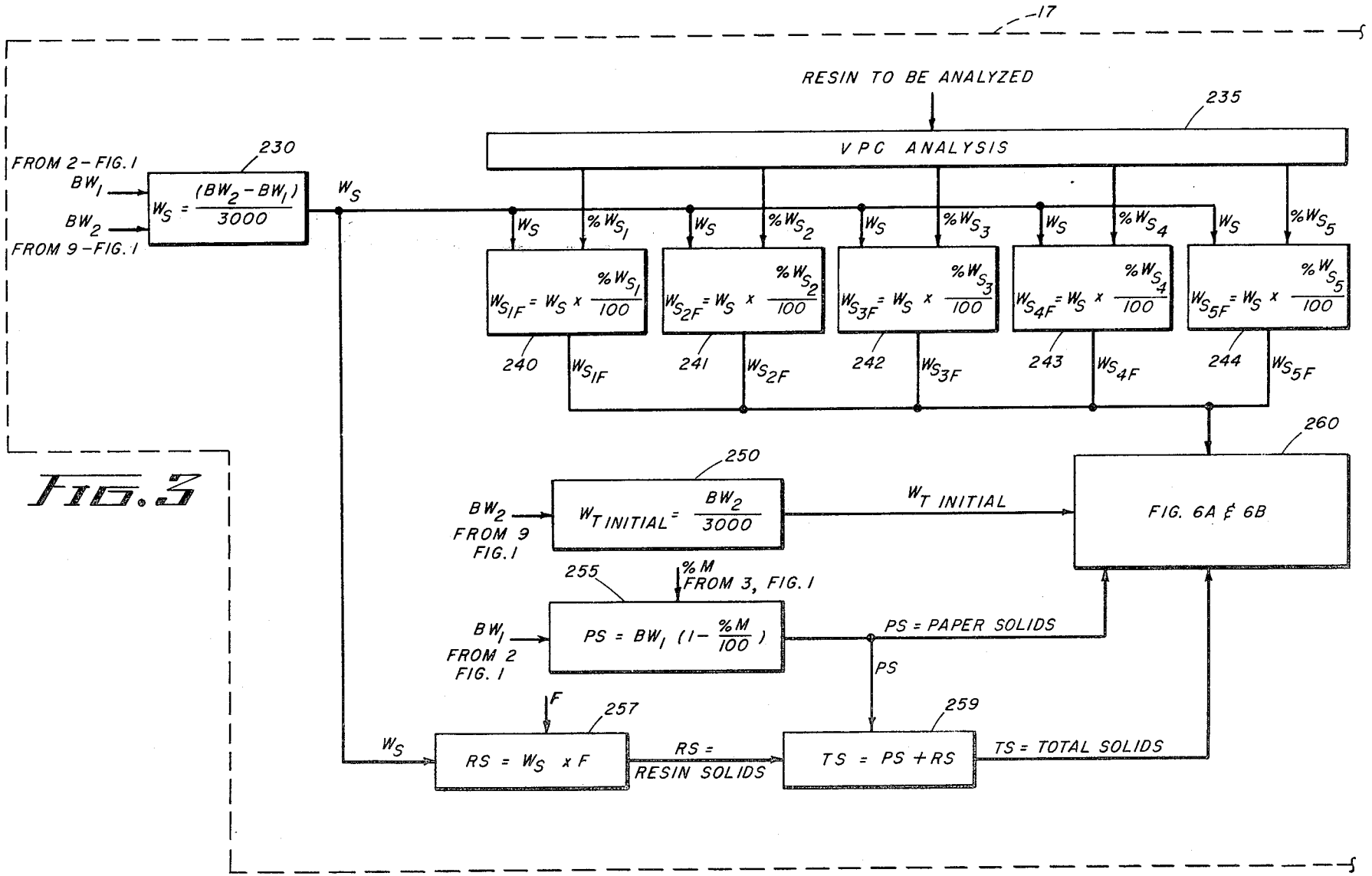
FIG. 7 is a diagram representing block 18 of FIG. 1 showing the calculations which are performed therein to determine gap settings and roll speed settings of the applicator.

A second exemplary model useful in block 19 to determine RSSP is set forth in FIG. 8 to which reference follows.

In this model, the raw paper basis weight, $BW_1$, from block 2, FIG. 1, is an input to block 1022 wherein is calculated the wet product basis weight, $BW_2$, using $KC_1$, a tuning factor which is determined by experimentation or alternatively may be calculated by reference to the percent Ra calculation, above. This $BW_2$ value is transmitted to block 1023 along with $LS_A$ from block 13, FIG. 1, and KRR, a tuning factor, to again calculate the desired applicator roll speed set point, RSSP, which is outputted to block 18, FIG. 1, the interactive controller.

The interactive controller 18 consists of analog or digital components and can also comprise a system of equations run periodically in a digital or hard-wired computer system. The ratio, RT, between line speed set point, LSSP, from 17, and desired applicator roll speed set point, RSSP, from 19, is calculated in block 1120. It is important to note that set points rather than actual speeds are used in these calculations because "noise" caused by electronic measuring systems is reduced and control accuracy is improved thereby. In operation, block 1121 calculates the ratio deviation, DRT, from the desired ratio set point, RTSP and RT from block 1120. Block 1122 is a non-linear function generator having a gain, $K_R$, and a deadband, A. The equations used in the function generator 1122 to calculate the deviation ratio set point, DRTO, to be used for control of the applicator roll speed and the roll gaps are as follows:

if DRT > A, DRTO = KR (DRT-A)
if $-A \leq DRT \leq A$, DRTO = 0
if DRT < −A, DRTO = KR (DRT + A)

A can also be zero; in effect eliminating the deadband altogether. The output from the function generator 1122 is the input to block 1123 which multiplies the deviation ratio set point, DRTO, by the line speed set point, LSSP, from 17, FIG. 1, to determine the necessary modification of the applicator roll speed set point, DRSSP, to control the reverse roll applicator for the desired resin application, within the desired range, RTSP. Block 1126 calculates the new applicator roll speed set point, NRSSP, using RSSP from 19, FIG. 1, to be used by controller 15, FIG. 1, to control the resin application to the web.

In a similar manner, block 1124 calculates the change in gap setting, DGS, needed with the new applicator roll speed set point, NRSSP, to control resin application to the web to the desired resin level, by the equation:

$$DGS = KG.(DRSSP)$$

where KG = an arbitrary gain or tuning factor.

This equation relates the change in reverse roll speed, DRSSP, to the change in gap setting, DGS. The form of this equation can be considerably more complex, such as an equation fitted to experimental data. The tuning factor, KG, depends on many factors such as resin solids, viscosity etc. and also on reverse roll applicator parameters such as roll diameters etc. and is determined experimentally for each resin system employed on any specific applicator. DGS is the input to block 1127 along with the left side gap setting, LG, and the right side gap setting, RG, both from 14, FIG. 1. By adding DGS to both LG and RG, individually, the new left and right gap set points, LGSP and RGSP, respectively, are calculated and sent to roll gap sensor-controller 14, FIG. 1. The same DGS value is added to both LG and RG since the average resin content is to be controlled.

Thus, the instant invention simultaneously controls the applicator roll speed and the gap settings to maintain a given ratio between the roll speed and the material line speed, producing uniformly treated webs.

We claim:

1. A method of controlling the application of a resinous solution to a fibrous host material with a reverse roll applicator which comprises 1. providing a signal (A) representative of the required line speed set point of said applicator,
2. providing a signal (B) representative of the desired roll speed set point of said applicator,
3. calculating the ratio of said desired roll speed set point to said required line speed set point from said signal (A) and said signal (B) and providing a signal (C) representative of said ratio,
4. providing a signal (D) representative of the desired set point of said ratio,
5. calculating the deviation of said signal (C) from said signal (D) and providing a signal (E) representative of said deviation,
6. calculating the required change in the desired roll speed set point of said applicator from said signals (A), (B) and (E) and providing a signal (F) representative of said required change,
7. modifying said signal (B) in response to said signal (F) and providing a signal (G) representative of the actual roll speed set point,
8. controlling the actual roll speed in accordance with said signal (G),
9. calculating the change required in the actual gap setting of said applicator to maintain the desired amount of resin application onto said host material from said signal (F) and providing a signal (H) representative of said gap setting change required,
10. providing a signal (I) representative of the actual gap settings of said applicator roll,
11. modifying said signal (I) in accordance with said signal (H) and providing a signal (J) representative of the new gap set point, and
12. controlling said applicator roll gap settings in accordance with said signal (J).

2. A method according to claim 1 wherein said signal (A) is provided by a. measuring the average temperature of the dryer within which the host material is to be dried and providing a signal (K) representative of said average temperature,
b. measuring the weight of said host material before application of said resinous solution and providing a signal (L) representative of said weight, and
c. calculating said required line speed set point from said signals (K) and (L) and providing said signal (A).

3. A method according to claim 2 which includes a. calculating the desired weight of the impregnated host material after drying from said signal (L), providing a signal (M) representative of said desired weight and calculating said signal (A) from said signals (M) and (K).

4. A method according to claim 1 wherein said signal (A) is provided by a. measuring the weight of said host material before application of said resinous solution thereto and providing a signal (L) representative of said weight, b. measuring the weight of said host material after application of said resinous solution thereto and before drying and providing a signal (N) representative of said weight before drying, c. measuring the weight of said host material after application of said resinous solution thereto and after drying and providing a signal (O) representative of said weight after drying, d. providing a signal (P) representative of the resin solids fraction of said resinous solution, e. calculating from said signals (L), (N), (O) and (P) the actual percent volatiles of the impregnated, dried material and providing a signal (Q) representative of said actual percent volatiles, f. providing a signal (R) representative of the specification percent volatiles of the impregnated, dried material, g. providing a signal (S) representative of the solvent component percentages and a signal (T) representative of the latent heat of vaporization of each solvent component of said resinous solution, h. measuring the actual line speed of said host material and providing a signal (U) representative of said actual line speed, i. providing a signal (V) representative of the length of the dryer, j. measuring the dryer temperature and providing a signal (W) representative of said dryer temperature, k. providing a signal (X) representative of the heat capacity of the host material, l. computing the actual film coefficient of said host material after resinous solution application thereto and during drying from said signals (L), (N), (P), (Q), (S), (T), (U), (V), (W) and (X) and providing a signal (Y) representative of said actual film coefficient and m. calculating said required line speed set point from said signals (L), (N), (P), (R), (S), (T), (V), (W), (X) and (Y) and providing said signal (A).

5. A method according to claim 1 wherein said desired roll speed set point is calculated by I. measuring the weight of said host material before resinous solution application thereto and providing a signal (L) representative of said weight, II. providing a signal (Z) representative of a first gain tuning factor, III. computing the weight of said host material after resinous solution application thereto and before drying from said signals (L) and (Z) and providing a signal (AA) representative of said computed weight, IV. providing a signal (U) representative of the actual line speed of said host material, V. providing a signal (BB) representative of a second tuning factor, and VI. calculating said desired roll speed set point from said signals (AA), (U) and (BB) and providing said signal (B).

6. In a fibrous host material treating process wherein said material is treated with a resinous solution in a reverse roll applicator and dried in a dryer, apparatus for controlling the application of said solution comprising 1. means for providing a signal (A) representative of the required line speed set point of said applicator, 2. means for providing a signal (B) representative of the desired roll speed set point of said applicator, 3. means responsive to said signal (A) and signal (B) for calculating the ratio of said desired roll speed set point to said required line speed set point and providing a signal (C) representative of said ratio, 4. means for providing a signal (D) representative of the desired set point of said ratio, 5. means responsive to said signal (C) and signal (D) for calculating the deviation of said signal (C) from said signal (D) and providing a signal (E) representative of said deviation, 6. means responsive to said signals (A), (B) and (E) for calculating the required change in the desired roll speed set point of said applicator and providing a signal (F) representative of said required change, 7. means responsive to said signal (F) for modifying said signal (B) and providing a signal (G) representative of the actual roll speed set point, 8. means responsive to said signal (G) for controlling the actual roll speed, 9. means responsive to said signal (F) for calculating the change required in the actual gap setting of said applicator to maintain the desired amount of resin application onto said host material and providing a signal (H) representative of said gap setting change required.

10. means for providing a signal (I) representative of the actual gap settings of said applicator roll, 11. means responsive to said signal (H) for modifying said signal (I) and providing a signal (J) representative of the new gap set point and 12. means responsive to said signal (J) for controlling said applicator roll gap settings.

7. An apparatus according to claim 6 wherein said means for providing said signal (A) comprises a. means for measuring the average temperature of the dryer within which the host material is to be dried and providing a signal (K) representative of said average temperature, b. means for measuring the weight of said host material before application of said resinous solution and providing a signal (L) representative of said weight, and c. means responsive to said signal (K) and signal (L) for calculating said required line speed set point and providing said signal (A).

8. An apparatus according to claim 7 which includes a. means responsive to said signal (L) for calculating the desired weight of the impregnated host material after drying, providing a signal (M) representative of said desired weight and calculating said signal (A) from said signals (K), and (M).

9. An apparatus according to claim 6 wherein said means for providing said signal (A) comprises a. first gauge means adjacent to said material for measuring the weight of said material before resinous solution application thereto and providing a signal (L) representative of said weight, b. second gauge means adjacent to said material for measuring the weight of said host material after resinous solution application thereto and before drying and providing a signal (N) representative of said weight before drying, c. third gauge means adjacent to said material for measuring the weight of said host material after resinous solution application thereto and after drying and providing a signal (O) representative of said weight after drying, d. means for providing a signal (P) representative of the resin solids fraction of said resinous solution, e. means responsive to said signals (L), (N), (O) and (P) for computing the actual percent volatiles of the impregnated, dried material and providing a signal (Q) representative of said actual percent volatiles, f. means for providing a signal (R) representative of the specification percent volatiles of the dried, impregnated material, g. means for providing a signal (S) representative of the solvent component percentages and a signal (T) representative of the heat of vaporization of each solvent component of said resinous solution, h. means for measuring the actual line speed of said material and providing a signal (U) representative of said actual line speed, i. means for providing a signal (V) representative of the dryer length, j. means for measuring the temperature of said dryer and providing a signal (W) representative of said dryer temperature, k. means for providing a signal (X) representative of the heat capacity of said host material, l. means responsive to said signals (L), (N), (P), (Q), (S), (T), (U), (V), (W) and (X) for computing the actual film coefficient of said host material after resinous solution application thereto and during drying and providing a signal (Y) representative of said actual film coefficient, and m. means responsive to said signals (L), (N); (P), (R), (S), (T), (V), (W), (X) and (Y) for calculating said required line speed set point and providing said signal (A).

10. An apparatus according to claim 6 wherein said means for calculating said desired roll speed set point comprises I. means for measuring the weight of said host material before resinous solution application thereto and providing a signal (L) representative of said weight, II. means for providing a signal (Z) representative of a first gain tuning factor, III. means responsive to said signals (L) and (Z) for computing the weight of said host material after resinous solution application thereto and before drying and producing a signal (AA) representative of said computed weight, IV. means for providing a signal (U) representative of the actual line speed of said host material, V. means for providing a signal (BB) representative of a second tuning factor, and VI. means responsive to said signals (AA), (U) and (BB) for calculating said desired roll speed set point and providing said signal (B).

* * * * *